US005267534A

United States Patent [19]

Berlinger

[11] Patent Number: 5,267,534

[45] Date of Patent: Dec. 7, 1993

[54] PISTON COOLING NOZZLE

[75] Inventor: Willibald G. Berlinger, Peoria, Ill.

[73] Assignee: Caterpillar Inc., Peoria, Ill.

[21] Appl. No.: 829,015

[22] PCT Filed: Sep. 9, 1991

[86] PCT No.: PCT/US91/06408

§ 371 Date: Sep. 9, 1991

§ 102(e) Date: Sep. 9, 1991

[51] Int. Cl.[5] ..... F01P 1/04

[52] U.S. Cl. ..... 123/41.35

[58] Field of Search ..... 123/41.34, 41.35

[56] References Cited

U.S. PATENT DOCUMENTS 4,067,307 1/1978 Hofle et al. ..... 123/41.35
4,508,065 4/1985 Suchdev ..... 123/41.35
4,979,473 12/1990 Lee ..... 123/41.35

FOREIGN PATENT DOCUMENTS 2938431 3/1981 Fed. Rep. of Germany .

*Primary Examiner*—Noah P. Kamen
*Attorney, Agent, or Firm*—Larry G. Cain

[57] ABSTRACT

Existing cooling jets used with present day engines must be manufactured and assembled to precisely direct the coolant to the proper location within the engine to insure efficient cooling of the components within the engine. Many of the present day cooling jets include a structural body having a piece of tubing bent in a preestablished configuration to direct the coolant to the appropriate area within the engine. The cooling nozzle (60) of the present invention includes a non-metallic body (64) and a metallic insert (110). The non-metallic body (64) includes a single passage (84) therein which has a first transition area (92) for directing a cooling fluid (50) into a pair of passages (86) to provide smooth, reduced turbulences and reduced eddie currents. The cooling nozzle (60) further includes a second transition area (100) for directing the cooling fluid (50) from the pair of passages (86) into a second pair of passages (94) being of a different cross-sectional area to provide a smooth, reduced turbulences and reduced eddie currents. The metallic insert (110) prevents the non-metallic nozzle (60) from being crushed when assembled to the engine (12). Thus, the cooling nozzle (60) of the present invention results in a low cost efficient cooling nozzle (60).

28 Claims, 4 Drawing Sheets

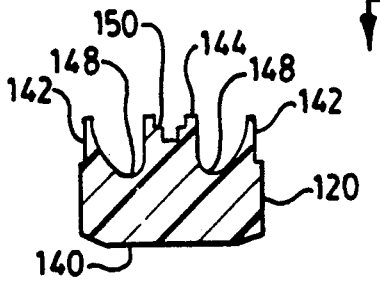
Fig. 8.
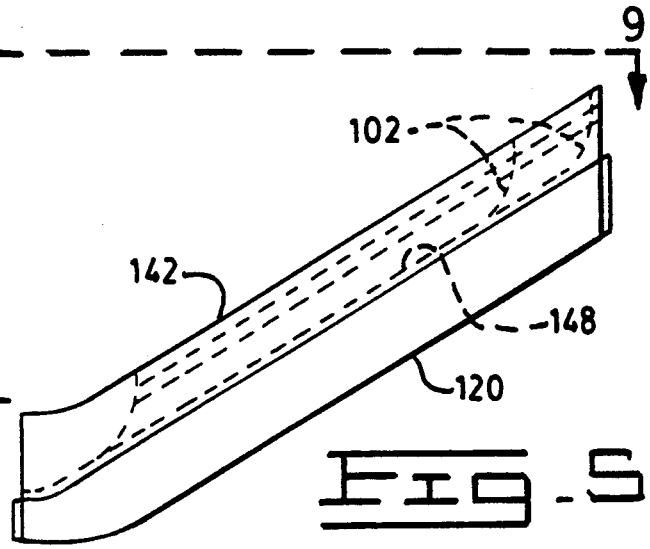
Fig. 5.
Fig. 9.
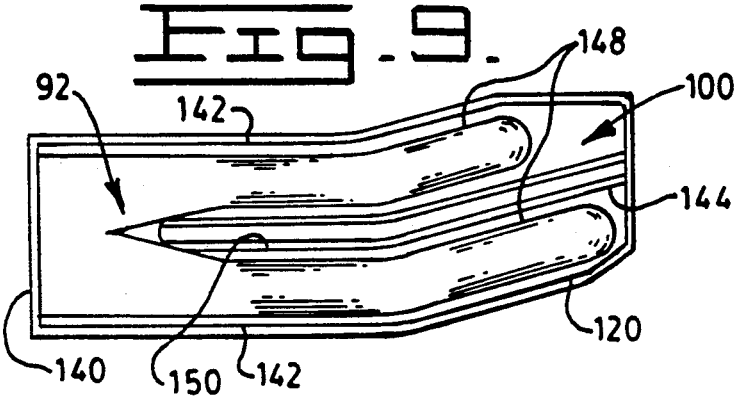
Fig. 10.
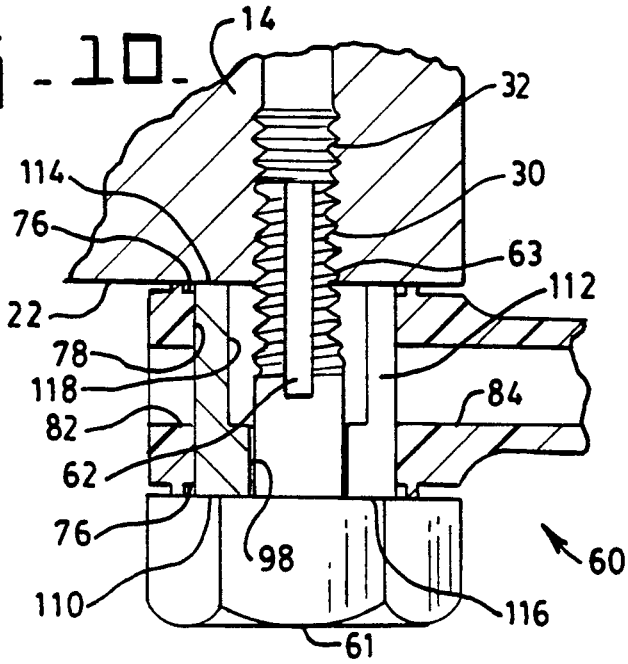

PISTON COOLING NOZZLE

TECHNICAL FIELD

This invention relates generally to internal combustion engines and more particularly to a cooling system including a cooling nozzle or cooling jet used to cool the underside of a piston, and the piston ring band while lubricating the piston pin.

BACKGROUND ART

The last several years have seen an increasing amount of emphasis on designing engines more compactly and yet with improved fuel economy and efficiency, reduced emissions, greater service life, and an increased power output per cylinder. As present day engines are converted or upgraded, the piston assembly is subjected to even higher combustion chamber pressures and temperatures. Attempts have been made to overcome the effects of higher temperatures induced into pistons. One of the primary paths attempted has been to increase the efficiency of heat rejected from the piston crown. For example, many of today's high output engines employ cooling of the underside of the piston crown by spraying a cooling medium against the underside of the hot crown. The cooling medium absorbs a portion of the heat within the crown, falls away from the crown, is cooled and recycled to cool the piston crown again. To insure efficient cooling of the undercrown, the spray must be precisely directed to best remain in contact with the undercrown to absorb the heat therefrom.

U.S. Pat. No. 4,979,473 to Thomas R. Lee issued Dec. 25, 1990 discloses an example of a nozzle used to cool the underside of a piston. The nozzle includes a two piece assembly. The assembly includes a structural body attached to the engine and a formed tube having one end swedged forming an orifice and the other end attached to the body. The body includes a passage and a bore intersecting the passage. The end of the tube being attached to the body is positioned in the bore. Thus, the flow area between the two pieces of the assembly fail to provide a smooth efficient flow of cooling fluid Another example of such a cooling arrangement is disclosed in U.S. Pat. No. 4,206,726 to John L. Johnson, Jr. issued Jun. 10, 1980. A nozzle is mounted to the engine and includes a first jet and a second jet. The first jet is directed to a central cavity on the underside within a piston and the second jet is directed to a coolant-receiving passage within the piston. The nozzle is formed from an elbow-shaped casting having a passage extending the length of the casting. A pair of plugs are threadedly positioned in each end of the passage. A pair of straight line bores intersect the passage and terminate in exit orifices. To insure that the column of coolant will be highly directionalized, the cross-sectional configuration along the bore's length is identical and its length to diameter ratio at the orifice is in the range of 13:1 to 15:1.

U.S. Pat. No. 2,800,199 to Rudolf Schmidl, issued Jul. 23, 1957 discloses another nozzle arrangement for cooling a piston. In this arrangement, the nozzle includes a cast housing having generally centered passage therein. One end of the passage is closed by a threaded plug and the other end of the passage intersects with a bore. A replaceable nozzle tip is threadedly positioned in one end of the bore and has an orifice therein through which the stream of cooling media exits and is directed to the underside of a piston.

Thus, the geometry within the nozzle to insure efficient flow, reduced turbulences, reduces eddie currents and positioning the proper stream or spray from the nozzle is critical in efficiently cooling the undercrown of the piston assembly.

DISCLOSURE OF THE INVENTION

In one aspect of the invention, a cooling nozzle is disclosed for cooling a piston in an internal combustion engine. The cooling nozzle directs a spray of cooling fluid from the engine cooling reservoir to a portion of the piston selected to achieve the optimum cooling of the piston. The cooling nozzle is comprised of a body including a boss portion, a connector portion axially extending from the boss portion, an intermediate portion extending from the axis of the connector portion and an outlet portion extending from the intermediate portion. The boss portion has a pair of mounting surfaces defining a bore therebetween. The bore is in fluid communication with the cooling passage. The connector portion has a single passage extending along the axis and in fluid communication with the bore. The intermediate portion has a pair of passages therein being in fluid communication with the single passage. The outlet portion has a pair of passages therein in fluid communication with each of the corresponding passage of the pair of passages in the intermediate portion. The cooling nozzle further includes a first transition area interposed between the single passage and the pair of passages in the intermediate portion and a second transition area interposed between each of the pair of passages in the intermediate portion and the pair of passages in the outlet portion.

In another aspect of the invention, a cooling system has been adapted for use with an internal combustion engine having a flow of cooling fluid being circulated through the engine within a plurality of cooling passages. The plurality of cooling passages have a portion of the cooling fluid used for cooling a piston. The cooling system is comprised of a cooling nozzle having a body and being adapted to spray cooling fluid therefrom to a portion of the piston selected to achieve the optimum cooling of the piston. The body includes a boss portion, a connector portion axially extending from the boss portion, an intermediate portion extending from the axis of the connector portion, and an outlet portion extending from the intermediate portion. The boss portion has a pair of mounting surfaces defining a bore therebetween. The bore is in fluid communication with the cooling passage. The connector portion has a single passage extending along the axis and in fluid communication with the bore. The intermediate portion has a pair of passages therein being in fluid communication with the single passage. The outlet portion has a pair of passages therein in fluid communication with the each corresponding passage of the pair of passages in the intermediate portion. The cooling nozzle further includes a first transition area interposed between the single passage and the pair of passages in the intermediate portion and a second transition area interposed between each of the pair of passages in the intermediate portion and the pair of passages in the outlet portion.

In another aspect of the invention, a method of making a cooling nozzle when in use has a flow of cooling fluid passing through at least a single passage therein and the flow of cooling fluid being substantially smooth, and turbulence and eddie currents being at a minimum. The method of making the cooling nozzle is comprised of the following steps of: molding a body having a bore, an opening and a passage therein using a multi-piece mold; molding a cover within a separate mold; attaching the cover within the opening to the body; and installing an insert within the bore within the body.

BRIEF DESCRIPTION OF THE DRAWINGS

FIG. 5 is a detailed side view of a cover included in the cooling nozzle;

FIG. 8 is a detailed sectional development view taken along line 8—8 of FIG. 5 of only the cover of the cooling nozzle before assembly;

FIG. 9 is a top view of the cover taken along line 9—9 of FIG. 5; and

FIG. 10 is an enlarged sectional view taken within circle 10 of FIG. 1.

BEST MODE FOR CARRYING OUT THE INVENTION

Figure 1:
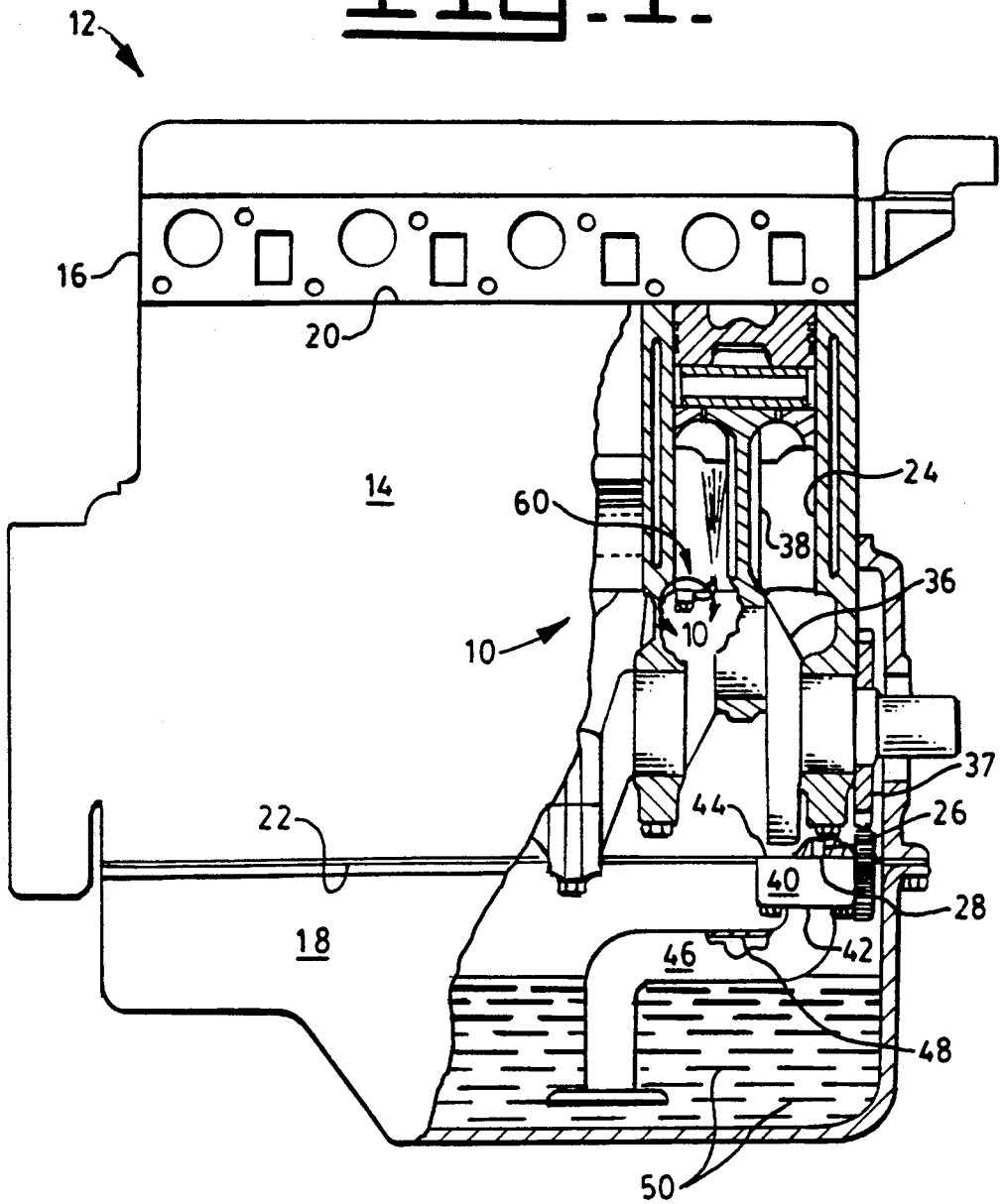
FIG. 1 is a cross-sectional, diagrammatic view of an internal combustion engine embodying the cooling system of this invention.

A cooling system 10 according to the invention is illustrated in FIG. 1. The cooling system 10 is positioned in a conventional internal combustion engine 12 including a cylinder block 14, a cylinder head 16 and a cooling reservoir 18. The cylinder block 14 has a top mounting surface 20 and a bottom mounting surface 22. The block 14 has a plurality of cylinder bores 24, only one shown in its entirety, and a plurality of cooling passages 26, of which only two are partially shown, defined therein. Each of the plurality of cylinder bores 24 could have a liner positioned therein without changing the gist of the invention. At least a portion of the cooling passages 26 have an inlet portion 28 and an outlet portion 30 therein. As best shown in FIG. 10, the outlet portion 30 further includes a threaded bore 32 within the block 14. The cylinder head 16 is attached to the block 14 at the top mounting surface 20 in a conventional manner such as by a plurality of bolts, not shown. A crankshaft 36 is rotatably attached near the bottom mounting surface 22 in a conventional manner. Reciprocatively positioned within each of the cylinder bores 24 and rotatively attached to the crankshaft 36 is a plurality of piston and rod assemblies 38. The engine 12 further includes a pump 40 attached near the bottom mounting surface 22. The pump 40 has an inlet, not shown, positioned in an inlet side 42 and an outlet, not shown, positioned in an outlet side 44 and is drivingly connected to the crankshaft 36 in a conventional manner, such as by a plurality of gears 45. The pump 40 further includes a suction bell and intake pipe assembly 46 attached to the inlet in the inlet side 42 of the pump 40. The assembly 46 is positioned within the cooling reservoir 18 and has a passage 48 therein. In this application, a cooling fluid, typically oil, designated by the numeral 50, is positioned in the reservoir 18 and is communicated through the passage 48 and through the pump 40. The outlet in the outlet side 44 of the pump 40 is connected to the inlet portion 28 of the plurality of cooling passages 26 in the block 14 and the cooling fluid 50 is circulated through the appropriate area when the engine 12 is operating.

Attached to the outlet portion 30 in at least a portion of the plurality of cooling passages 26, as will be discussed more fully, is a plurality of cooling nozzles 60, only one shown. As best shown in FIG. 1, each of the cooling nozzles 60 are attached to the block 14 in a conventional manner. For example, as best shown in FIG. 10, an enlarged headed bolt 6 has an axial groove 62 along a treaded portion 63 thereof. The remainder of the threads are threadedly attached in the threaded bore 32. Thus, the groove 61 allows the cooling fluid 50 to be in fluid communication between the cooling passage 26 and each of the nozzles 60.

Figure 2:
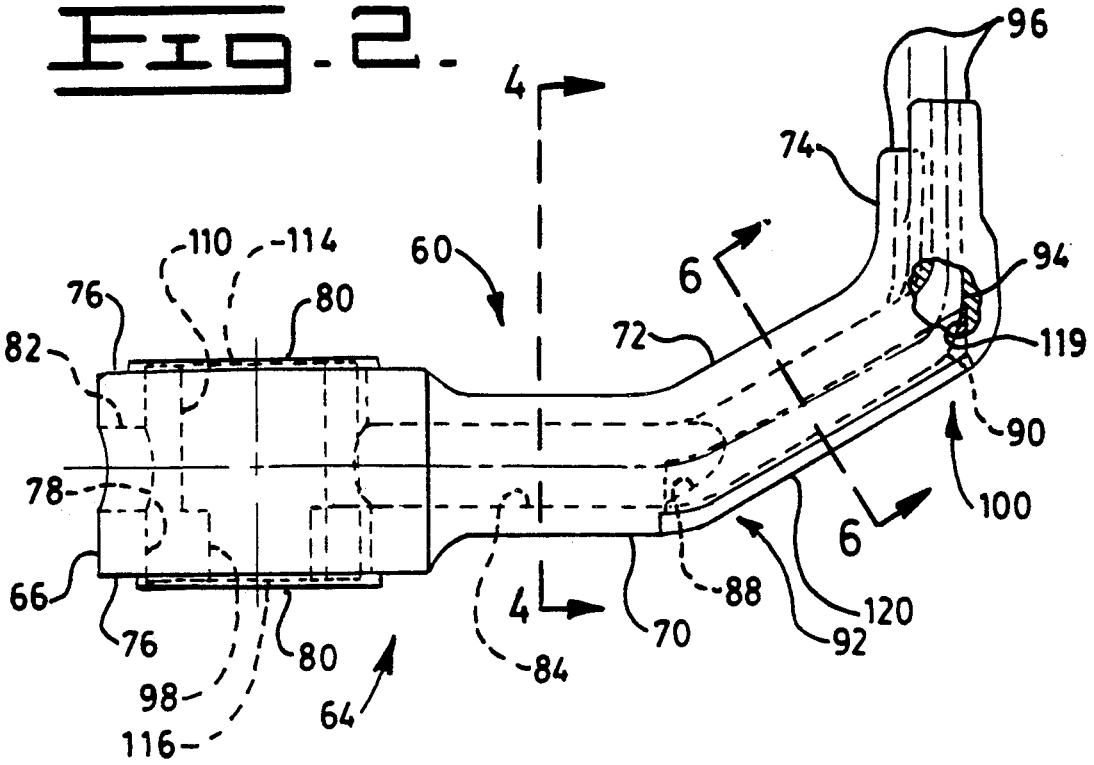
FIG. 2 is a side view of one of the cooling nozzles being partially sectioned.
Figure 3:
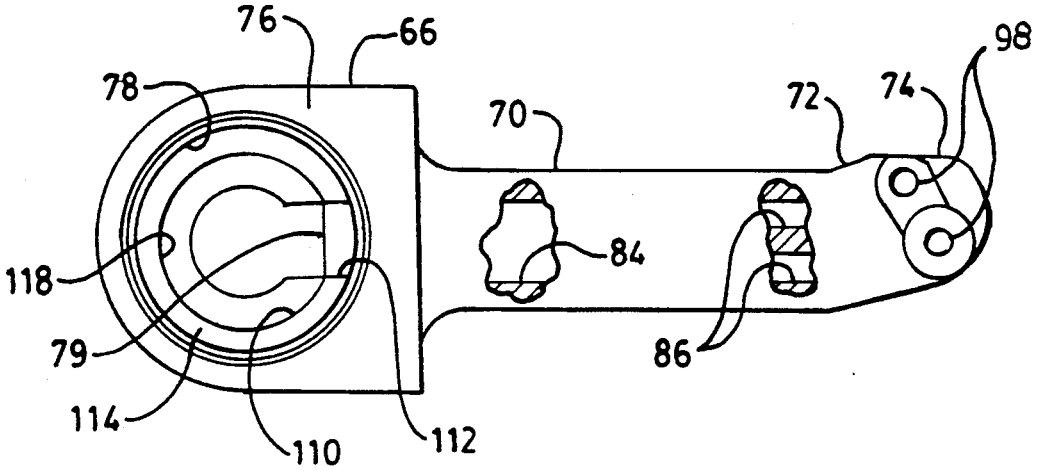
FIG. 3 is a top view of one of the cooling nozzles being partially sectioned.
Figure 4:
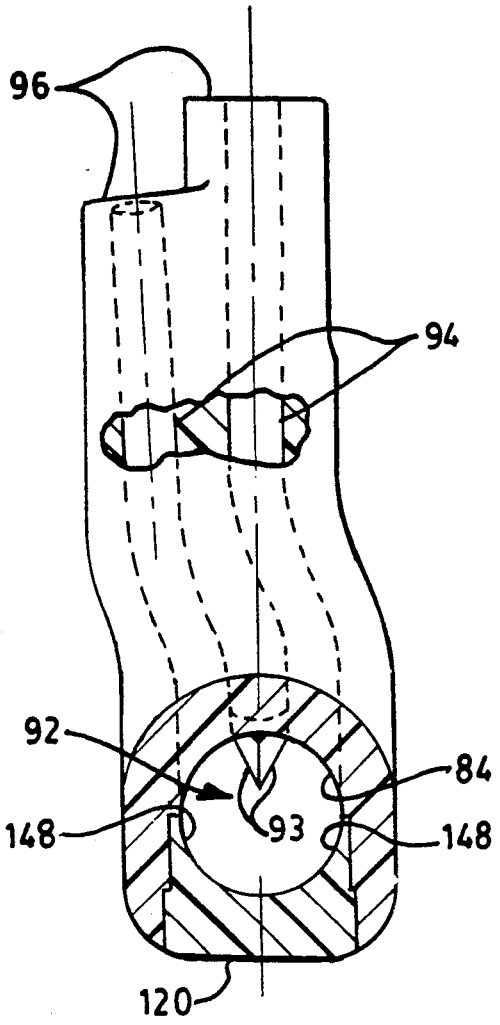
FIG. 4 is a detailed sectional view of a portion of the cooling nozzle taken along line 4—4 of FIG. 2.

As best shown in FIGS. 2 and 3, each of the nozzles 60 includes a body 64 having a boss portion 66, a connector portion 70 axially extending from the boss portion 66, an intermediate portion 72 extending from the axis of the connector portion 70 and angling therefrom at about 30 degrees and an outlet portion 74 further extending from the intermediate portion 72 and angling therefrom at about 60 degrees to the intermediate portion 72 and at an angle of about 90 degrees to the connector portion 70. As an alternative, the pair of passages 84 could extend through the connector portion 70 and be in fluid communication between the pair of passages 86 in the intermediate portion 72 and the bore 78 in the boss portion 66. The boss portion 66 includes a pair of mounting surfaces 76 having a bore 78 extending therebetween. A protrusion 79 extends partially into the bore 78. Each of the mounting surfaces 76 have a raised portion 80 extending therefrom which radially surrounds the bore 78. Positioned axially within the connector portion 70 is a single passage 84 extending along the axis of the connector portion 70. An extension of the single passage 84 passes through the bore 78 in the boss portion 66. Positioned within the intermediate portion 72 are a pair of passages 86 which are in fluid communication with the single passage 84. The outlet portion 74 extends from the intermediate portion 72 at an angle of about 90 degrees from the connector portion 70. Each of the pair of passages 86 include an inlet end 88 and an outlet end 90. The inlet end 88 of each of the pair of passages 86 has a first transition area 92 positioned between the single passage 84 and the pair of passages 86. As best shown in FIG. 4, the transition area 92 includes a plurality of blending surfaces 93 blendingly interconnecting the single passage 84 and the pair of passages 86. As further shown in FIG. 4, positioned within the outlet portion 74 is a pair of passages 94 each being in fluid communication with the corresponding one of the pair of passages 86 in the intermediate portion 72. An exit end 96 of the outlet portion 74 includes a pair of openings 98 each having a preestablished area for the cooling fluid 50 to pass therethrough. The intersection between the outlet end 90 of the pair of passages 86 and the pair of passages 94 in the outlet portion 74 has a second transition area 100 therein. The second transition area 100 includes a plurality of blending surfaces 102 interconnecting each of the pair of passages 86 with each of the corresponding pair of passages 94.

As best shown in FIGS. 3 and 10, an insert 110 is positioned within the bore 78 of the boss portion 66. The insert 110 has a generally cylindrical configuration and is generally "C" shaped having an opening 112 therein. The insert 110, in this application, is made of a metallic material such as steel. As an alternative, the insert 110 could be made of copper, brass or stainless steel. The insert 110 has a top surface 114 and a bottom surface 116. The insert 110 further includes a through bore 98 extending between the top and bottom surfaces 114,116 therein and has a preestablished diameter, which in this application is about 8.7 mm. A counterbore 118 is positioned in the insert 110, concentric with the through bore 98 and has a diameter larger than the preestablished diameter of the through bore 98. The counterbore 118 begins at the top surface 114 and stops at a preestablished depth intermediate the top surface 114 and the bottom surface 116. In the assembled position, the preestablished depth of the counterbore 118 is positioned generally in line with the bottom of the single passage 84.

In the assembled position, the insert 110 is positioned within the bore 78 of the boss portion 66 with the opening 112 axially aligned with the single passage 84. Although the respective top and bottom surfaces 114,116 of the insert 110 extends beyond corresponding ones of each of the mounting surfaces 76 of the boss portion 66, the raised portions 80 surrounding the bore 78 extends beyond the top and bottom surfaces 114,116 of the insert 110. In this application, insert 110 extends beyond the corresponding mounting surfaces 76 of the boss portion 66 by about 0.25 mm and the raised portion 80 extends beyond the top and bottom surfaces 114,116 of the insert 110 by about 0.25 mm.

Figure 6:
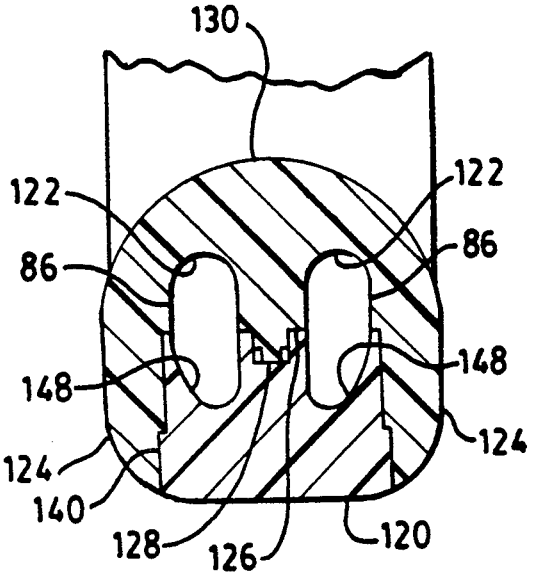
FIG. 6 is a sectional view taken along line 6—6 of FIG. 2 disclosing the details of the cover and an intermediate portion of the cooling nozzle after being assembled.
Figure 7:
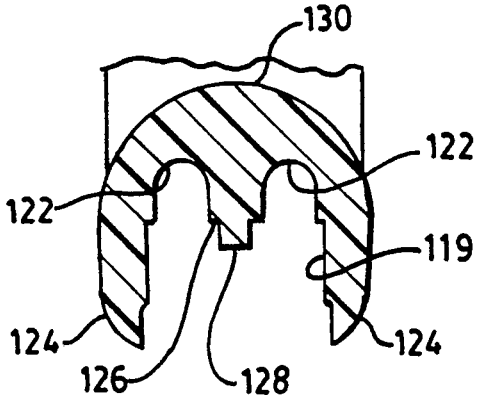
FIG. 7 is a detailed sectional development view taken along line 6—6 of FIG. 2 of only the intermediate portion of the cooling nozzle before assembly.

As best shown in FIGS. 2 and 5, the body 64, precisely the intermediate portion 72, includes an opening 119 therein having a cap or cover 120 positioned therein, partially shown with the broken lines in FIG. 2. .As best shown in FIGS. 6 and 7, the intermediate portion 72 of the body 64 defines a pair of channels 122 which form a portion of each of the pair of passages 86. The pair of channels 122 have a preestablished shape or configuration. The pair of channels 122 have a generally "U" shaped configuration. The intermediate portion 72 further includes a pair of walls 124, one of each being positioned, on each side of the pair of channels 122 and has a thickness of approximately 2 mm. A web 126 is positioned between the pair of channels 122 and, in this application, has a thickness of approximately 6 mm. Extending from the web 126 is a tang portion 128 having a preestablished width, which in this application is about 2 mm. A bridge portion 130 connects the pair of walls 124 and the web 126. The bridge portion 130 has a generally semicircular exterior configuration.

The cover 120, as best shown in FIGS. 5, 8 and 9, includes a base 140 having a generally rectangular configuration and a pair of stepped legs 142 extending therefrom. An intermediate wall 144 extending from the base 140 terminates short of one of the ends of the base 140 and is centered between the stepped legs 142. A pair of generally "U" shaped grooves 148 are defined by the intermediate wall 144 and the stepped legs 142. Each of the pair of grooves 148 is spaced from each other a preestablished distance, which in this application is about 2 mm. Positioned within the intermediate wall 144 and centered between the pair of grooved portions 146 is a "T" shaped notch 150. As will be clarified later, several preestablished interference fits are provided for use with the sonic welding . For example, the widest part of the "T" shaped notch 150 has a width slightly less than the width of the tang portion 128 in the intermediate portion 72. For example, in this application the width of the widest part of the "T" shaped notch 150 is about 1.5 mm, and stated earlier, the width of the tang portion 128 is about 2 mm. Corresponding ones of the pair of grooves 148 make up a portion of the pair of passages 86 in the intermediate portion 72 of the body 64.

As best shown in FIGS. 4 and 9, the first transition area 92 at the inlet end 88 of each of the pair of passages 86 has a portion thereof positioned in the cover 120. The first transition area 92 blendingly communicates the cooling fluid 50 from the single passage 84 into the pair of passages 86 in the intermediate portion 72. The first transition area 92 is constructed to provide a smooth cooling flow with reduced turbulences and eddie currents.

As best shown in FIGS. 2, 3, 5 and 9 the second transition area 100 is partially positioned in the cover 120 and the remainder is positioned in the outlet portion 74 of the body 64. The second transition area 100 blendingly communicates the cooling fluid 50 from the pair of passages 86 in the intermediate portion 72 to the corresponding pair of passages 94 in the outlet portion 74. The second transition area 100 is constructed to provide a smooth cooling flow with reduced turbulences and eddie currents.

The body 64 and cover 120 of the cooling nozzle 60 is manufactured by using a conventional injection molding process. The process as used requires at least two different molds and a liquifiable material such as a thermosetting plastic. For example, although not shown, a first mold is used to manufacture the body 64 and a second mold is used to manufacture the cover 120.

INDUSTRIAL APPLICABILITY

After the body 64 and the cover 120 are formed, the two pieces are assembled, a force is applied between the body 64 and the cover 20 and the pieces are sonic welded together forming a cooling nozzle 60 less the insert 110. The force applied between the body 64 and the cover 120 in conjunction with the sonic weld causes the preestablished interference fits, such as between the pair of walls 124 on the intermediate portion 72 and the pair of stepped legs 142 on the cover 120, and the tang portion 128 and the "T" shaped notch 150 to melt, flow together and permanently bond into a single member, resulting in the formation of the non-metallic portion of the cooling nozzle 60. The as molded body 64 and the as molded cover 120 require no machining. After being assembled, the welded body 64 and cover 120 require no machining. The insert 110 is lightly pressed into the welded body 64 and cover 120 with the opening 112 aligned with the single passage 84 and the counterbore 118 directed toward the block 14 resulting in the finished cooling nozzle 60. As stated earlier, the resulting position of the insert 110 to that of the body 64 is such that the insert 110 is intermediate the raised portions 80 of the body 64.

In operation, the cooling nozzle 60 is assembled to the cylinder block 14. For example, the bolt 62 is inserted into the insert 110, which is positioned over the outlet portion 30, and tightened into the threaded bore 32 in the block 14. As the bolt 62 is tightened, the raised portions 80 on each of the mounting surface 76 contact corresponding surfaces on the block 14 and the enlarged head of the bolt 62 and form a seal therebetween.

Thus, the cooling fluid 50 is drawn from the reservoir 18 by the pump 40 through the suction bell and intake pipe assembly 46 and directed into the plurality of cooling passages 26. From a portion of the cooling passages 26, the cooling fluid 50 enters into the cooling nozzle 60. The fluid 50 travels along the passage 84 to the inlet end 88 through the first transition area 92 wherein the cooling fluid 50 is blendingly and smoothly directed into the pair of passages 86. From the pair of passages 86 the fluid 50 travels through the second transition area 92 wherein the cooling fluid 50 is blendingly and smoothly directed into the pair of passages 94 and exits the pair of openings 98. The pair of passages 94 have identical cross-sectional areas; but as an alternative; the pair of passages 94 could have different cross-sectional areas without changing the gist of the invention. In this application, each of the pair of openings 98 correspond to the cross-sectional area of the corresponding one of the pair of passages 94 and is used to direct the cooling fluid 50 to separate portions of the piston and rod assembly 38.

The present cooling nozzle 60 has proven to provide an economical and efficient means for rejecting heat from portion of the piston and rod assembly 38. The passages 84,86,94 and the transition areas 92,100 provide for a smooth, tranquil, low turbulence, low eddie currents and non-interrupted flow of the cooling fluid 50.

I claim:

1. A cooling nozzle (60) for cooling a piston (38) in an internal combustion engine (12) by directing a spray of the cooling fluid (50) from the engine (12) cooling reservoir (18) to a portion of the piston selected to achieve the optimum cooling of a portion of the piston (38), said cooling nozzle (60) comprises:

a body (64) including a boss portion (66), a connector portion (70) axially extending from the boss portion (66), an intermediate portion (72) extending from the axis of the connector portion (70) and an outlet portion (74) extending from the intermediate portion (74);

said boss portion (66) having a pair of mounting surfaces (76) defining a bore (78) therebetween;

said connector portion (70) having a single passage (84) extending along the axis and being in communication with the bore (78);

said connector portion (72) having a pair of passages (86) therein being in fluid communication with the single passage (84);

said outlet portion (74) having a pair of passages (94) one of the pair of passages (94) being in fluid communication with the corresponding passage of the pair of passages (86) in the intermediate portion (72); and a first transition area (92) interposed between the single passage (84) and the pair of passages (86) in the intermediate portion (72) and a second transition area (100) interposed between each of the pair of passages (86) in the intermediate portion (72) and the pair of passages (94) in the outlet portion (74).

2. The cooling nozzle (60) of claim 1, wherein said intermediate portion (72) extends from the connector portion (70) at an angle of about 30 degrees.

3. The cooling nozzle (60) of claim 2, wherein said outlet portion (74) extends from the intermediate portion (72) at an angle of about 60 degrees and from the connector portion (70) at an angle of about 90 degrees.

4. The cooling nozzle (60) of claim 1, wherein said boss portion (66), said connector portion (70), said intermediate portion (72) and said outlet portion (74) are made of a non-metallic material and said intermediate portion (72) includes an opening (119), a cover (120) disposed within the opening and being fixedly attached.

5. The cooling nozzle (60) of claim 4, wherein said intermediate portion (72) includes a pair of channels (122) which make up a portion of each of the pair of passages (86) in the intermediate portion (72) and said cover (120) includes a pair of grooves (148) which make up the remainder of each of the pair of passages (86) in the intermediate portion (72).

6. The cooling nozzle (60) of claim 4, wherein a portion of said first transition area (92) is positioned in the cover (120).

7. The cooling nozzle (60) of claim 4, wherein a portion of said second transition area (100) is positioned in the cover (120).

8. The cooling nozzle (60) of claim 1, wherein said boss portion (66) includes a generally "C" shaped insert (110) having an opening (112) therein positioned within the bore (78) with the opening (112) in substantially alignment with the single passage (84) in the connector portion (70).

9. The cooling nozzle (60) of claim 8, wherein said boss portion (66) further includes a raised portion (80) extending from each of the mounting surfaces (76) and said insert is positioned intermediate the raised portions (80).

10. The cooling nozzle (60) of claim 1, wherein said first transition area (92) includes a plurality of blending surfaces (93).

11. The cooling nozzle (60) of claim 1 wherein said second transition area (100) includes a plurality of blending surfaces (102).

12. A cooling system (10) adapted for use with an internal combustion engine (12) having a flow of cooling fluid (50) being circulated through the engine (12) within a plurality of cooling passages (26) and having a portion of the cooling fluid (50) used for cooling a piston (38); said cooling system comprising:

a cooling nozzle (60) having a body (64) and adapted to spray cooling fluid (50) therefrom to a portion of the piston (38) selected to achieve the optimum cooling of the piston (38);

said body (64) including a boss portion (66), a connector portion (70) axially extending from the boss portion (66), an intermediate portion(72) extending from the axis of the connector portion (70) and an outlet portion (74) extending from the intermediate portion (74);

said boss portion (66) having a pair of mounting surfaces (76) defining a bore (78) therebetween being in fluid communication with the cooling passage (26);

said connector portion (70) having a single passage (84) extending along the axis and being in fluid communication with the bore (78);

said intermediate portion (72) having a pair of passages (86) therein being in fluid communication with the single passage (84);

said outlet portion (74) having a pair of passages (94) therein with each being in fluid communication with each corresponding passage of the pair of passages (86) in the intermediate portion (72); and a first transition area (92) interposed between the single passage (84) and the pair of passages (86) in the intermediate portion (72) and a second transition area (100) interposed between each of the pair of passages (86) in the intermediate portion (72) and the pair of passages (94) in the outlet portion (74).

13. The cooling system (10) of claim 12, wherein said intermediate portion (72) extends from the connector portion (70) at an angle of about 45 degrees.

14. The cooling system (10) of claim 13, wherein said outlet portion (74) extends from the intermediate portion (72) at an angle of about 45 degrees and from the connector portion (70) at an angle of about 90 degrees.

15. The cooling system (10) of claim 12 wherein said boss portion (66), said connector portion (70), said intermediate portion (72) and said outlet portion (74) are made of a non-metallic material and said intermediate portion (72) includes an opening (119), a cover (120) disposed within the opening and being fixedly attached.

16. The cooling system (10) of claim 15, wherein said intermediate portion (72) includes a pair of channels (122) which make up a portion of each of the pair of passages (86) in the intermediate portion (72) and said cover (120) includes a pair of grooves (148) which make up the remainder of each of the pair of passages (86) in the intermediate portion (72).

17. The cooling system (10) of claim 16, wherein a portion of said first transition area (92) is positioned in the cover (120).

18. The cooling system (10) of claim 15, wherein a portion of said second transition area (100) is positioned in the cover (120).

19. The cooling system (10) of claim 12 wherein said boss portion (66) includes a generally "C" shaped insert (110) having an opening (112) therein positioned within the bore (78).

20. The cooling system (10) of claim 19 wherein said boss portion (66) further includes a raised portion (80) extending from each of the mounting surfaces (76) and said insert is positioned intermediate of the raised portions (80).

21. The cooling system (10) of claim 12 wherein said first transition (92) includes a plurality of blending surfaces (93).

22. The cooling system (10) of claim 12 wherein said second transition (100) includes a plurality of blending surfaces (102).

23. A cooling nozzle (60) for cooling a piston (38) in an internal combustion engine (12) by directing a spray of the cooling fluid (50) from the engine (12) cooling reservoir (18) to a portion of the piston selected to achieve the optimum cooling of a portion of the piston (38), said cooling nozzle (60) comprises:

a body (64) including a boss portion (66), a connector portion (70) axially extending from the boss portion (66), an intermediate portion (72) extending from the axis of the connector portion (70) and an outlet portion (74) extending from the intermediate portion (74);

said boss portion (66) having a pair of mounting surfaces (76) defining a bore (78) therebetween;

said connector portion (70) having at least one passage (84) extending along the axis and being in communication with the bore (78);

said intermediate portion (72) having a pair of passages (86) therein being in communication with the at least one passage (84);

said outlet portion (74) having a pair of passages (94) being in fluid communication with a corresponding one of the pair of passages (86) in the intermediate portion (72); and a first transition area (92) interposed between the at least one passage (84) and the pair of passages (86) in the intermediate portion (72) and a second transition area (100) interposed between each of the pair of passages (86) in the intermediate portion (72) and the pair of passages (94) in the outlet portion (74).

24. The cooling nozzle (60) of claim 23, wherein said outlet portion (74) extends from the intermediate portion (72) at an angle of about 90 degrees from the connector portion (70).

25. The cooling nozzle (60) of claim 23, wherein said boss portion (66), said connector portion (70), said intermediate portion (72) and said outlet portion (74) are made of a non-metallic material.

26. The cooling nozzle (60) of claim 23, wherein said boss portion (66) includes a generally "C" shaped insert (110) having an opening (112) therein positioned within the bore (78) with the opening (112) being in substantial alignment with the at least one passage (84) in the connector portion (70).

27. The cooling nozzle (60) of claim 26, wherein said boss portion (66) further includes a raised portion (80) extending from each of the mounting surfaces (76) and said insert is positioned intermediate the raised portions (80).

28. The cooling nozzle (60) of claim 23, wherein said first transition area (92) includes a plurality of blending surfaces (93) and said second transition area (100) includes a plurality of blending surfaces (102).

* * * * *

UNITED STATES PATENT AND TRADEMARK OFFICE

CERTIFICATE OF CORRECTION

PATENT NO. : 5,267,534

DATED : 12/7/93

INVENTOR(S) : WILLIBALD G. BERLINGER

It is certified that error appears in the above-identified patent and that said Letters Patent is hereby corrected as shown below:

Claim 1, column 7, line 50, delete "connector" and insert --intermediate-- therefor.

Claim 20, column 9, line 40, delete "of".

Signed and Sealed this

Seventh Day of June, 1994

Bruce Lehman

*Attest:*

BRUCE LEHMAN

*Attesting Officer*

*Commissioner of Patents and Trademarks*